United States Patent [19]

Mosely et al.

[11] 4,079,793

[45] Mar. 21, 1978

[54] EXHAUST MEANS FOR PERCUSSION TOOLS

[75] Inventors: Neal J. Mosely, Houston; William I. Wohlfeld, San Angelo, both of Tex.

[73] Assignee: Reed Tool Co., Houston, Tex.

[21] Appl. No.: 729,760

[22] Filed: Oct. 5, 1976

[51] Int. Cl.[2] ..... E21B 21/00

[52] U.S. Cl. ..... 173/80; 173/73; 173/132

[58] Field of Search ..... 173/73, 80, 17, 15, 173/78, 132

[56] References Cited

U.S. PATENT DOCUMENTS

| | | | |
|---|---|---|---|
| 3,180,434 | 4/1965 | Vincent | 173/73 |
| 3,198,264 | 8/1965 | Oelke et al. | 173/78 |
| 3,595,323 | 7/1971 | Schindler | 173/80 |
| 3,924,690 | 12/1975 | Shaw | 173/80 |
| 3,986,565 | 10/1976 | Atkinson | 173/80 |
| 3,991,834 | 11/1976 | Curington | 173/80 |

*Primary Examiner*—Robert Hafer
*Attorney, Agent, or Firm*—Neal J. Mosely

[57] ABSTRACT

In one type of pneumatic percussion drilling tool, the pneumatic motor has an anvil-bit which is slidable in the forward end of the motor casing between a normal working position and an abnormal advanced position when the tool is hanging off bottom and the pneumatic fluid is caused to bypass the hammer-piston and blow continuously through the anvil-bit. In order to prevent tapping or chattering of the hammer-piston at such time, as a result of leakage of the pneumatic fluid into the forward working chamber, this chamber is vented by means of one or more passages formed in the surface of the anvil-bit member which are open while the tool is blowing and which are closed in the normal operating position of the anvil-bit member. Since the passages are only in the surface of the anvil-bit member, the structure eliminates the need for special configurations of parts to provide interconnecting recesses and passages as in certain of the prior art.

12 Claims, 5 Drawing Figures

EXHAUST MEANS FOR PERCUSSION TOOLS

BACKGROUND OF THE INVENTION

1. Field of the Invention

This invention relates to pneumatic percussion-type drill motors of a type known as downhole hammers for drilling or boring through the earth. The invention is more particularly directed to novel means for preventing operation of the hammer-piston and for exhausting the compressed air or other pneumatic fluid past the anvil-bit when the tool is hung off bottom.

2. Description of the Prior Art

Schindler U.S. Pat. No. 3,503,459 discloses and claims a pneumatic percussion motor in which the compressed air or pneumatic fluid supply passages extend through portions of the casing which functions as a whole as a load-carrying structure, as distinguished from conventional prior art pneumatic motors in which separate, non-load-containing sleeves are provided for forming the fluid-carrying passages. The reciprocating hammer-piston has a central exhaust passage which is aligned with a similar passage extending through the anvil-bit slidably received in the forward end of the casing. Finger valves project from the motor back head and the anvil-bit for alternately entering and sealing the central exhaust passage in the hammer-piston during reciprocation thereof and the hammer-piston also having annular passages which alternately register with ports in the casing to direct the working fluid to the opposite ends of the casing for causing the hammer-piston to reciprocate and beat upon the anvil-bit. This structure has the slight disadvantage that when the motor is supported off bottom with the anvil-bit member in a dropped position there is a tendency for compressed air or other pneumatic fluid to be trapped in the working chamber causing the hammer-piston to beat upon the anvil-bit member. It is desirable therefore to have a structure which permits exhausting of the compressed air or pneumatic fluid when the tool is supported with the anvil-bit member in a dropped position.

Various prior art means have been devised for achieving an exhausting of the compressed air when a tool is supported off bottom. Collier, et al U.S. Pat. No. 3,311,177 discloses a type of percussion drill motor in which both the compressed air and the exhaust are conducted through a central porting stem which extends through the piston and into the exhaust duct in the anvil-bit. The anvil-bit, and particularly the exhaust duct therein, is specially configured to provide for exhausting of the forward end of the motor chamber when the tool is suspended off bottom. However, this arrangement cannot be utilized in the percussion motor of the type shown in Schindler U.S. Pat. No. 3,503,459 in which the central porting stem is omitted. In other prior art devices, a centrally bored hammer piston, in its abnormally advanced hanging position, uncovers a blowing port whereby compressed air is bypassed through the anvil and bit.

In Schindler, et al U.S. Pat. No. 3,595,323 there is disclosed a percussion drilling tool of the type shown in Schindler U.S. Pat. No. 3,503,459, in which the working chamber of the tool is vented by means of recesses and passages in the anvil-bit and its mounting chuck or driver sub and/or in the casing, which passages are interconnected only when the tool is blowing and which are disconnected in the normal operating position of the anvil. This tool requires special configurations of parts to provide the interconnecting recesses and passages to provide the desired exhaust of compressed air from the working chamber when the tool is raised off bottom and the anvil-bit is in the dropped position.

SUMMARY OF THE INVENTION

In accordance with the present invention, there is provided a pneumatic motor or tool of the type known as a downhole hammer, having an axially bored piston in a casing, an anvil-bit slidably received in a driver sub or chuck member mounted in the forward end of the casing, and valving for alternately directing compressed air or other pneumatic fluid into opposite ends of the working chamber in the casing. The anvil-bit drops or advances abnormally when the tool is hung off bottom. One or more recesses are provided in the surface of the anvil-bit member which are closed when the anvil-bit is in a normal working position and are open to exhaust compressed air from the forward working chamber when the anvil-bit is in the abnormally advanced or dropped position. The passage or passages in the surface of the anvil-bit constitute the sole passage or passages required for exhausting compressed air from the working chamber and avoid the necessity for special configurations of parts providing interconnecting recesses and passages as in Schindler, et al U.S. Pat. No. 3,595,323. The anvil-bit member of this invention is interchangeable with the anvil-bit member of Schindler U.S. Pat. No. 3,503,459 and of Schindler, et al U.S. Pat. No. 3,595,323.

DESCRIPTION OF THE PREFERRED EMBODIMENTS

Figure 1:
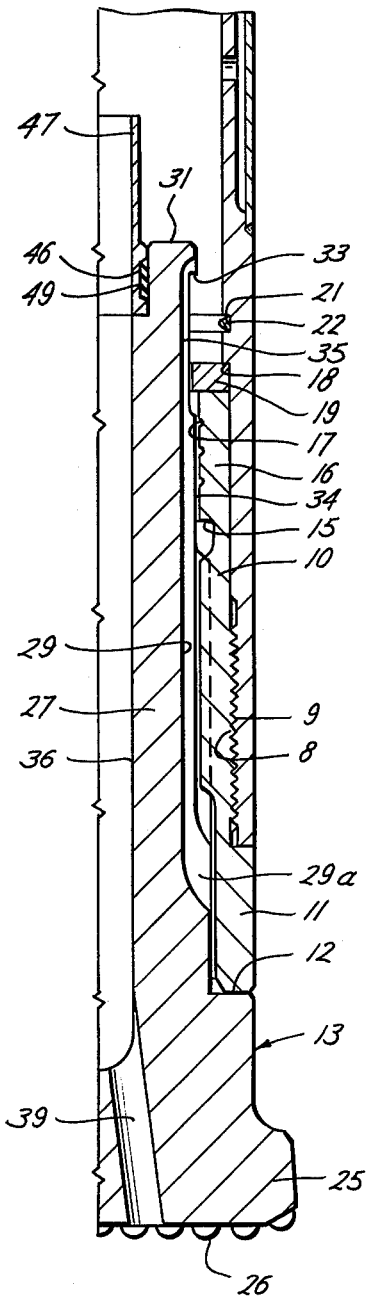
FIG. 1 is a half longitudinal section illustrating the lower or forward portion of a pneumatic percussion drill motor embodying one form of the present invention, the anvil-bit being shown in its normal operating position, as when the tool is resting on bottom.

The casing 5 of the pneumatic hammer motor (see FIGS. 1 and 2) while incorporating pneumatic fluid supply passages as at 6, and forward supply ports 7, is of structurally rugged design, as described in Schindler U.S. Pat. No. 3,503,459. It should be noted that this invention resides primarily in an improved anvil-bit member to be used in the pneumatic hammer motor and is an improvement on the exhaust arrangement shown in Schindler, et al U.S. Pat. No. 3,595,323.

The forward end of the casing 5 is internally threaded as at 8 for attachment of the externally threaded intermediate portion 9 of a generally annular driver sub or chuck member designated 10. A thickened collar 11 at the forward extremity of chuck member 10 abuts the end of casing 5. An anvil-bit member 13 having a horizontal shoulder 12 normally abuts the forward or lower end of collar 11 when the pneumatic hammer is supported in a normal operating position.

Between the upper end of intermediate portion 9 of chuck member 10 and a thickened upper portion 16 thereof having oil grooves 17 in its inner surface, there is provided an internal shoulder 15. An anvil-bit retainer ring 19, which is formed of two split halves, is secured in position by chuck member 10 against inner shoulder 18 in casing 5. An additional resiliant split ring 22 is mounted in an internal groove 21 in casing 5 just above ring 19.

The anvil-bit member 13 includes a forward or lowermost cutter bit portion 25 which has hardened cutter inserts 26, preferably of tungsten carbide or the like. Anvil-bit member 13 has an intermediate shank portion 27 with splines 28 and splineways 29. Anvil-bit member 13 has an uppermost or rearwardly extending impact-receiving head portion having an upper striking surface 31 which is arranged to receive impact blows from the hammer-piston 32, and is provided with a shoulder as at 33.

Figure 2:
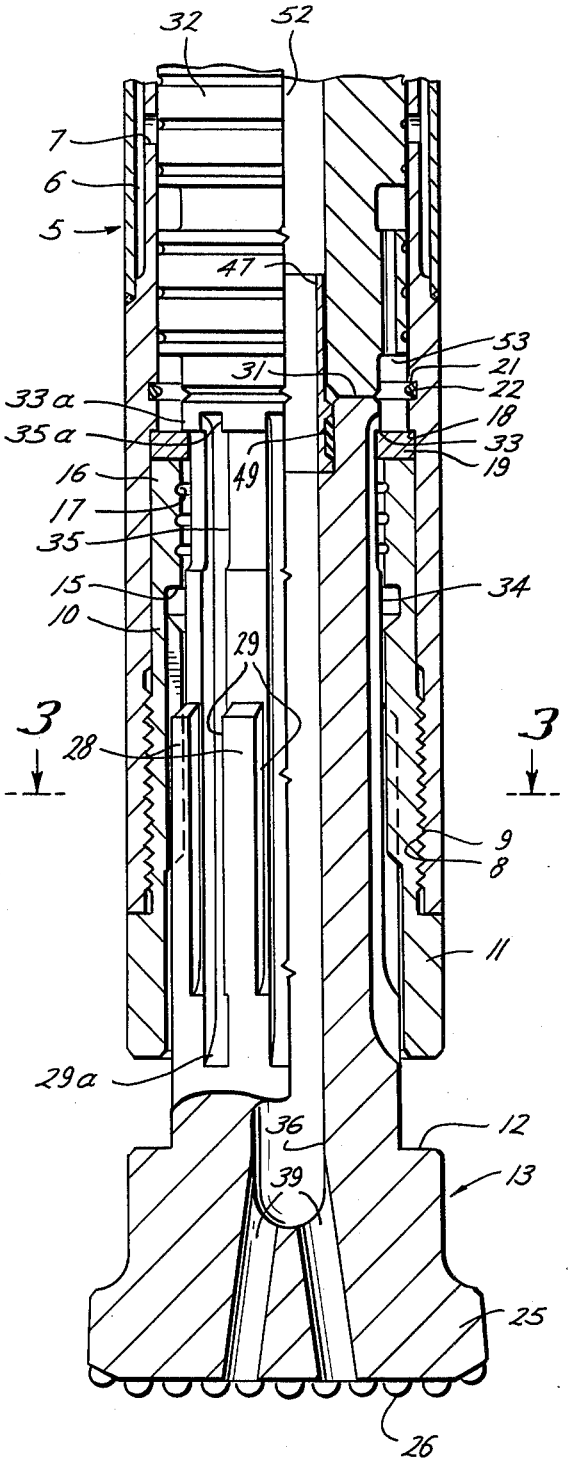
FIG. 2 is a longitudinal section illustrating the lower or forward portion of a percussion drill motor, as in FIG. 1, but with the anvil-bit being shown in its abnormally advanced position, as when the tool is suspended off bottom, the view being partially in central longitudinal section and partly in elevation.

Between the impact receiving surface 31 and the splined shank portion 27, the outer surface of the anvil-bit member has a cylindrical surface 34 which guides the movement of the anvil-bit member by sliding within the bore of the upper portion 16 of chuck member or driver sub 10. The surface of anvil-bit member 13 is provided with longitudinally extending grooves 35 which open at their upper ends into the side wall **33*a* of the shouldered portion 33 and are aligned with and form a part of the grooves or splineways 29 extending between the splines 28. The lower ends of splineways 29 extend at their lower ends 29*a* to a point providing an exhaust opening for discharge of compressed air when anvil-bit member 13** is in a dropped position as shown in FIG. 2.

Anvil-bit member 13 is also provided with a longitudinally extending axial passageway 36 which terminates in divergent passages 39 for blowing compressed air through the cutting head to remove cuttings, as is well known.

Anvil-bit member 13 is guided in its sliding movement by engagement of the sliding surface 34 and the bore of the upper portion of driver sub or chuck member 16 and by engagement of the splined shank portion 27 with the abutting portion or mating surface of driver sub or chuck member 10, which is complementarily splined, so that the anvil-bit member and driver sub or chuck member, as well as casing 5, are constrained for rotary movement together.

Figure 3:
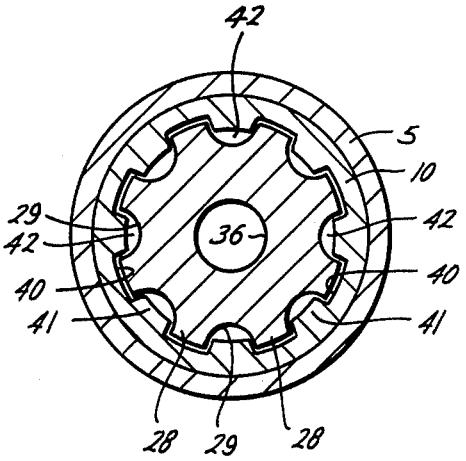
FIG. 3 is a sectional view taken on the line 3—3 of FIG. 1.

Driver sub or chuck member 10 is provided with splineways 40 which receive and guide splines 28 of anvil-bit member 13, and splines 41 which fit the complementary splineways 29 of anvil-bit member 13. It should be noted that splineways 29 are substantially deeper than is necessary to receive and guide splines 41 and a clearance therebetween is indicated in FIG. 3 as the passages 42. Passages 42 represent a continuous passage defined by the clearance between splineways 29 and splines 41 in the portion of the apparatus where guiding action is taking place and by the grooves 35 at the upper end of anvil-bit member 13. In this embodiment of the invention, the exhaust passages consist of continuous longitudinal passages located solely in the surface of anvil-bit member 13 and do not require special machining of the complementary portions, i.e., driver sub or chuck member 10, of the apparatus to provide the necessary passage for exhaust of compressed air from the working chamber. The lower ends **29*a* of splineways 29 are open to exhaust compressed air through the lower collar 11 of driver sub or chuck member 10 when in the dropped position and are sealed by the bore of the collar 11 when in the normal operating position. Split stopring 19 is rahter loosely received between casing 5 and the portion of the anvil-bit member just below the head 30 so that ring 19 does not function as a limiting guide for the shank, this function being performed entirely by driver sub or chuck member 10**.

Resiliently located in the countersunk rearward extremity 46 of anvil-bit member exhaust duct 36 is a short tubular element 47 which serves as a finger valve, as will be explained. This finger valve is flexibly anchored by a packing collar 49 of resilient material which permits some disalignment of the finger valve and anvil member.

When the apparatus is assembled, tubular driver sub or chuck member 10 is first inserted over the rearward extremity of anvil-bit member 13 and the respective splines and splineways engaged. Split retainer stopring halves 19 are then inserted in place between overhanging shoulder 33 and the rearward extremity of chuck member of driver sub 10. This sub assembly is then threaded into the forward extremity of casing 5 until the driver sub or chuck member 10, in effect, forms both the forward part of the casing and a part of the anvil. The limitation on this threading will be established by the annular shoulder at the top of chuck collar 11. Casing 5 will be secured by suitable means to the lower extremity of a string of drill pipe (not shown) through which pneumatic fluid, e.g., compressed air or other gas, will be supplied.

In running the tool into a well bore (not shown), the anvil-bit member 13 will hang in its abnormally advanced position, as shown in FIG. 2, with rearward percussion head shoulder 33 resting against stopring 19. In this suspended position of the anvil-bit member, hammer piston 32 likewise will be in an abnormally forward position and, as explained in Schindler U.S. Pat. No. 3,503,459, compressed air will be constantly bypassed through central axial passageway 52 in the piston and through registering finger valve element 47 and exhaust duct 36 in the anvil-bit member 13. At this time, ports 7 will be covered by the hammer piston 32 (see FIG. 2) and the forward or lower working chamber 53 within the casing will be vented through the continuous passages in the surface of anvil-bit member 13 formed by grooves 35 and splineways 39. Such venting of the forward chamber effectively prevents any leaking of compressed air or gas which may enter the forward working chamber for causing continued operation, i.e., tapping or chattering, of the hammer-piston 32 during this period. The suspended position of anvil-bit member 13 is also utilized in blowing out compressed air through exhaust passage 36 for cleaning out debris in the bottom of the hole. When bit 25 rests on the bottom of the bore hole and the drill string is dropped to cause collar 11 at the bottom of driver sub or chuck member 10 to bear against against shoulder 12 on the bit, the tool will be in operating or working position in which the compressed air or gas first will be directed through casing passages 6 and ports 7 to lift hammer-piston 32. When hammer piston 32 is lifted clear of finger valve 47, forward working chamber 53 will be exhausted through valve member 47 and exhaust duct 36 while the compressed air or gas applied to the rearward end of hammer-piston 32 will drive the same forward for striking the upper striking face 31 of anvil-bit member 13. Reciprocatory action of the hammer-piston 32 will continue as long as the tool is resting on bottom and compressed air or gas is supplied thereto at the proper pressure. The percussive blows thus applied to the anvil-bit member will be segregated from the casing because of the sliding action of the anvil-bit member permitted by its splined assembly with the casing through driver sub or chuck member 10.

The guiding of the anvil-bit solely within driver sub or chuck member 10 has substantial advantages both in manufacturing and in durability of the tool. Split ring 22 in the casing is normally cleared by hammer piston 32 even in the suspended position of FIG. 2. However, when the anvil-chuck assembly is removed, ring 22 prevents hammer piston 32 from dropping out of the casing. In this embodiment of the invention, the exhaust means which is provided offers substantial economy relative to the prior art. Inasmuch as the exhaust passage consists of a continuous groove in the surface of anvil-bit member 13 and does not require the machining of complementary passages in anvil-bit member 13 and driver sub or chuck member 10, a number of manufacturing steps are eliminated and the apparatus may be produced at substantially reduced cost.

Figure 4:
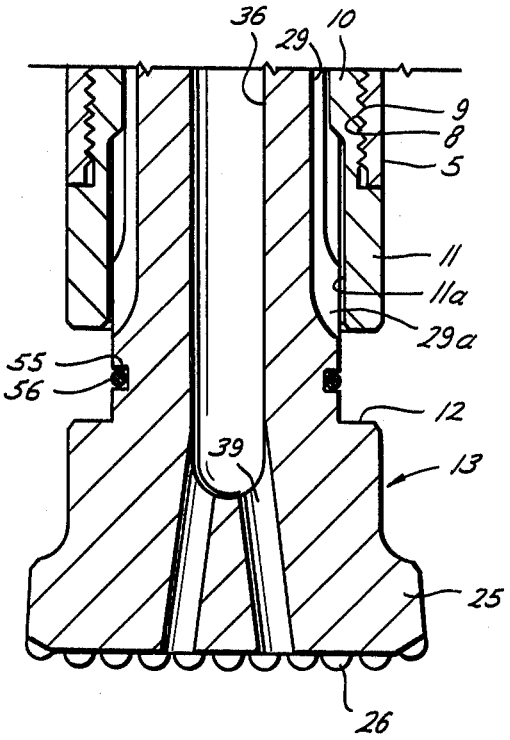
FIG. 4 is a sectional view similar to FIG. 2, showing an alternate embodiment including an "O" ring seal on the anvil-bit member.

In FIG. 4, there is shown an alternate embodiment of the invention providing for a seal against air leakage at the bottom of the anvil-bit member 13. FIG. 4 is a detail longitudinal sectional view of the lower end of the casing and hammer assembly and the parts are identical to those shown in FIGS. 1 to 3 and have the same reference numerals applied thereto and the same functions. The embodiment of claim 4 differs from that of the embodiment of FIGS. 1 to 3 only in that the anvil-bit member is provided with a peripheral groove 55 a short distance above the shoulder 12 and a rubber or other elastomeric "O" ring 56 positioned therein. The "0" ring 56 is clear of the wall of the bore of collar 11 in the dropped position but will engage and seal against the wall of the bore 11*a* when in the normal operating position. This embodiment provides for protection against leakage of air during normal operation. Without the "O" ring seal, the embodiment of FIGS. 1 to 3 would have a very slight leakage of air in the normal operating position of FIG. 1 since anvil-bit member 13 cannot have an air-tight seal in the bore 11*a*.

Figure 5:
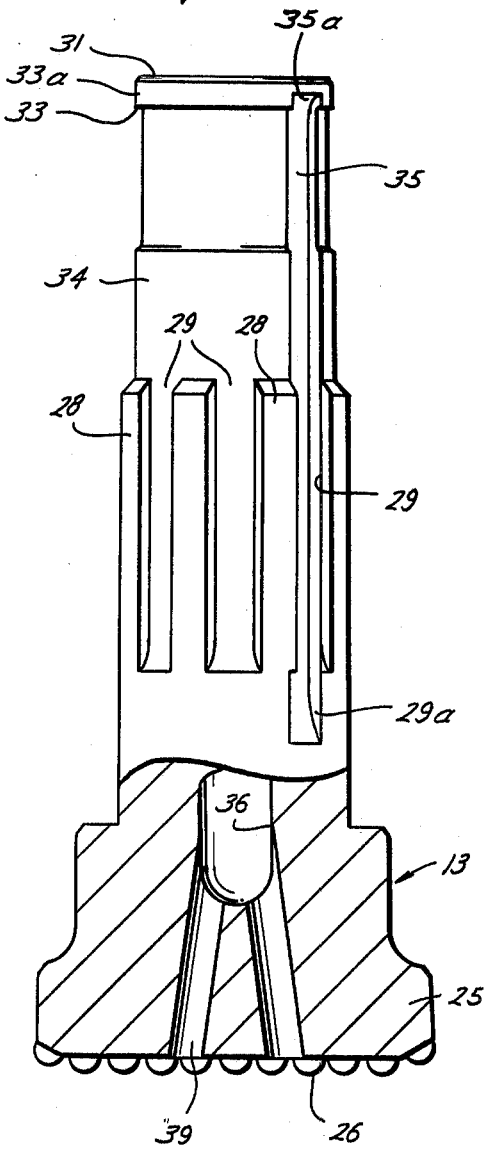
FIG. 5 is a view, partly in elevation and partly in section, of an alternate embodiment of the anvil-bit member having a single exhaust passage.

In FIG. 5 there is shown still another embodiment of the invention in which there is provided only a single passageway extending along the surface of anvil-bit member 13. In this embodiment, all of the splineways 29 except one are only as deep as the surface of the cylindrical portion 34. Only one of the splineways 29 is enlarged in depth and integral with groove 35 to provide a continuous exhaust passage. This embodiment is identical to that of FIGS. 1 to 3 except that there is only the single exhaust passage. If required by the amount of air to be discharged, the passage formed by groove 35 and cooperating splineway 29 can be slightly deeper than the corresponding grooves or passages in the embodiment of FIGS. 1 to 3. Obviously, the number of exhaust passages in the surface of anvil-bit member 13 can vary from a single passage as in FIG. 5 to as many passages as there are splineways 29, as in FIGS. 1 to 3. In addition, if desired, the grooves 35 can open through the face 31 of anvil-bit member 13, as shown in Schlinder, et al U.S. Pat. No. 3,595,323. This would be an operative embodiment but is not necessary to produce a satisfactory commercial device. As noted in the previous embodiments, it is not at all necessary for the exhaust groove 35 to open through the anvil face 31 which receives the blows of hammer-piston 32.

We claim:

1. The combination in a percussion drilling tool having a casing forming a working chamber, a connection at the rearward end of said chamber for working fluid, a chuck member secured in the forward end of said casing having interior splines and splineways, an anvil-bit member having exterior splines and splineways cooperable with the splines and splineways of said chuck member and slidable longitudinally therein between an abnormally advanced position when the tool is suspended off bottom and the normal working position, said anvil-bit member having a shouldered end portion with a striking end face and an axial exhaust duct, said shouldered end portion being spaced from said exterior splines by a cylindrical surface of reduced diameter relative to said splines having a sliding fit in said chuck member, a hammer piston reciprocable in said working chamber, and valving means for controlling the application of working fluid from said connection to the opposite ends of said chamber and for exhausting the same to cause said piston to beat upon said anvil-bit member end face; of means for exhausting the forward end of said working chamber when said anvil-bit member is in said abnormally advanced position, comprising at least one longitudinally extending groove in said reduced diameter cylindrical surface of said anvil-bit member aligned with and opening into and forming an extension of one of the splineways thereof and extending at one end through at least part of said shouldered end portion, said one splineway having a depth substantially greater than the heighth of the cooperating spline in said chuck member to provide a space therebetween forming an exhaust passage, and the forward end of said one splineway being open to exhaust when in said abnormally advanced position and being closed by the mating surface of said chuck member when in said normal working position.

2. The combination according to claim 1 in which said groove extends through the striking end face of said shouldered end portion of said anvil bit member.

3. The combination according to claim 1 in which there are provided a plurality of grooves in said anvil bit member each aligned with one of the splineways thereof.

4. The combination according to claim 1 in which said anvil bit member has a peripheral groove with an "O" ring seal positioned therein forward of the exhaust end of said one splineway, said seal being engageable with the inner surface of said chuck member in said normal working position and out of engagement therewith in said abnormally advanced position.

5. An anvil device for use in a percussion drilling tool of the type having a casing forming a working chamber and a hammer piston reciprocable in said chamber for beating upon said device, said anvil device including a chuck member for attachment in the forward portion of said casing having interior splines and splineways, and an anvil bit member having exterior splines and splineways cooperable with the splines and splineways of said chuck member and slidable longitudinally therein between normal working and abnormally advanced positions, said anvil bit member having a shouldered end portion with a striking end face and an axial exhaust duct, said shouldered end portion being spaced from said exterior splines by a cylindrical surface of reduced diameter relative to said splines having a sliding fit in said chuck member, means for exhausting the forward end of said working chamber when said anvil bit member is in said abnormally advanced position comprising at least one longitudinally extending groove in said reduced diameter cylindrical surface of said anvil bit member aligned with and opening into and forming an extension of one of the splineways thereof and extending at one end through at least part of said shouldered end portion, said one splineway having a depth substantially greater than the heighth of the cooperating spline in said chuck member to provide a space therebetween forming an exhaust passage, and the forward end of said splineway being open to exhaust when in said abnormally advanced position and being closed by the mating surface of said chuck member when in said normal working position.

6. An anvil device according to claim 5 in which said groove extends through the striking end face of said shouldered end portion of said anvil bit member.

7. An anvil device according to claim 5 in which there are provided a plurality of grooves in said anvil bit member each aligned with one of the splineways thereof.

8. An anvil device according to claim 5 in which said anvil bit member has a peripheral groove with an "O" ring seal positioned therein forward of the exhaust end of said one splineway, said seal being engageable with the inner surface of said chuck member in said normal working position and out of engagement therewith in said abnormally advanced position.

9. An anvil-bit member for mounting at the forward end of a drill tool of the type having a casing forming a working chamber, a chuck member secured in the forward end of said casing having interior splines and splineways, an anvil-bit member having exterior splines and splineways cooperable with the splines and splineways of said chuck member and slidable longitudinally therein, and a hammer piston reciprocable in said chamber for beating upon said anvil; said anvil-bit member having a shouldered end portion with a striking end face and an axial exhaust duct, said shouldered end portion being spaced from said exterior splines by a cylindrical surface of reduced diameter relative to said splines having a sliding fit in said chuck member, means on said anvil-bit member for exhausting the forward end of said working chamber when said anvil-bit member is in said abnormally advanced position comprising at least one longitudinally extending groove in said reduced diameter cylindrical surface of said anvil-bit member aligned with and opening into and forming an extension of one of the splineways thereof and extending at one end through at lease part of said shouldered end portion, said one splineway having a depth substantially greater than the heighth of the cooperating spline in said chuck member to provide a space therebetween forming an exhaust passage when assembled in said chuck member, and the forward end of said one splineway being positioned to be opened to exhaust when in said abnormally advanced position and slidable inside the mating surface of said chuck member to be closed thereby when in said normal working position.

10. An anvil-bit member according to claim 9 in which said groove extends through the striking end face of said shouldered end portion of said anvil bit member.

11. An anvil-bit member according to claim 9 in which there are provided a plurality of grooves in said anvil bit member each aligned with one of the splineways thereof.

12. An anvil-bit member according to claim 9 in which said anvil-bit member has a peripheral groove with an "O" ring seal positioned thereon forward of the exhaust end of said one splineway, said seal being engageable with the inner surface of said chuck member when assembled therein and positioned in said normal working position and out of engagement therewith in said abnormally advanced position.

* * * * *